US009498953B2

(12) United States Patent
Fuller et al.

(10) Patent No.: US 9,498,953 B2
(45) **Date of Patent: *Nov. 22, 2016**

(54) PRINTHEAD DIE WITH MULTIPLE TERMINATION RINGS

(71) Applicant: Hewlett-Packard Development Company, L.P., Houston, TX (US)

(72) Inventors: Anthony M. Fuller, Corvallis, OR (US); Rio Rivas, Corvallis, OR (US); Kellie Susanne Jensen, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 28 days.

This patent is subject to a terminal disclaimer.

(21) Appl. No.: 14/762,958

(22) PCT Filed: Jan. 23, 2013

(86) PCT No.: PCT/US2013/022626

§ 371 (c)(1),
(2) Date: Jul. 23, 2015

(87) PCT Pub. No.: WO2014/116207

PCT Pub. Date: Jul. 31, 2014

(65) Prior Publication Data

US 2015/0352843 A1 Dec. 10, 2015

(51) Int. Cl.

| | |
|---|---|
| ***B41J 2/135*** | (2006.01) |
| ***B41J 2/14*** | (2006.01) |
| ***C23C 28/00*** | (2006.01) |

(52) U.S. Cl.

CPC ..... *B41J 2/1433* (2013.01); *B41J 2/14129* (2013.01); *C23C 28/32* (2013.01); *C23C 28/321* (2013.01); *C23C 28/34* (2013.01); *C23C 28/341* (2013.01); *C23C 28/345* (2013.01); *B41J 2202/13* (2013.01)

(58) Field of Classification Search

CPC ..... B41J 2/1433; B41J 2/14129

See application file for complete search history.

(56) References Cited

U.S. PATENT DOCUMENTS

| | | | | |
|---|---|---|---|---|
| 6,331,049 | B1 | 12/2001 | Leban | |
| 7,198,358 | B2 | 4/2007 | Sun et al. | |
| 8,870,337 | B1 * | 10/2014 | Jensen | B41J 2/01 347/19 |
| 2002/0190328 | A1 | 12/2002 | Bryant et al. | |
| 2006/0066659 | A1 | 3/2006 | Giovanola et al. | |
| 2008/0099341 | A1 | 5/2008 | Giovanola et al. | |
| 2010/0020131 | A1 | 1/2010 | Nishi | |
| 2012/0293587 | A1 | 11/2012 | Bakker et al. | |

OTHER PUBLICATIONS

Search Report and Written Opinion for Application No. PCT/US2013/022626, mailed Oct. 10, 2013, 9 pgs.

* cited by examiner

*Primary Examiner* — Juanita D Jackson

(74) *Attorney, Agent, or Firm* — HP Inc—Patent Department

(57) ABSTRACT

A printhead die includes a SiO2 layer grown into a surface of a silicon substrate, and a dielectric layer deposited onto an interior surface area of a substrate. Multiple termination rings are formed around the interior surface area. Each ring is defined by an absence of the dielectric layer. A berm is located in between each termination ring. Each berm is defined by the presence of the dielectric layer.

18 Claims, 9 Drawing Sheets

PRINTHEAD DIE WITH MULTIPLE TERMINATION RINGS

BACKGROUND

An inkjet printhead is a microfluidic device that generally includes an electronic circuit on a silicon substrate and an ink firing chamber defined by an ink barrier and an orifice, or nozzle. Various microfabrication techniques used for fabricating semiconductors are also used in the fabrication of printheads. For example, many functional printhead chips or dies, are fabricated together on a single silicon wafer. The functional printhead dies are then separated from the wafer, or singulated, using a saw blade to cut the wafer along the thin, non-functional spacing (i.e., the saw street) between each die. As the saw moves along the saw street it makes a kerf, or slit in the wafer. The saw blade often causes chipping to occur along the kerf that can result in defective printhead dies and an overall reduction in the percentage yield when fabricating printheads.

BRIEF DESCRIPTION OF THE DRAWINGS

The present embodiments will now be described, by way of example, with reference to the accompanying drawings, in which.

DETAILED DESCRIPTION

Overview

Figure 1A:
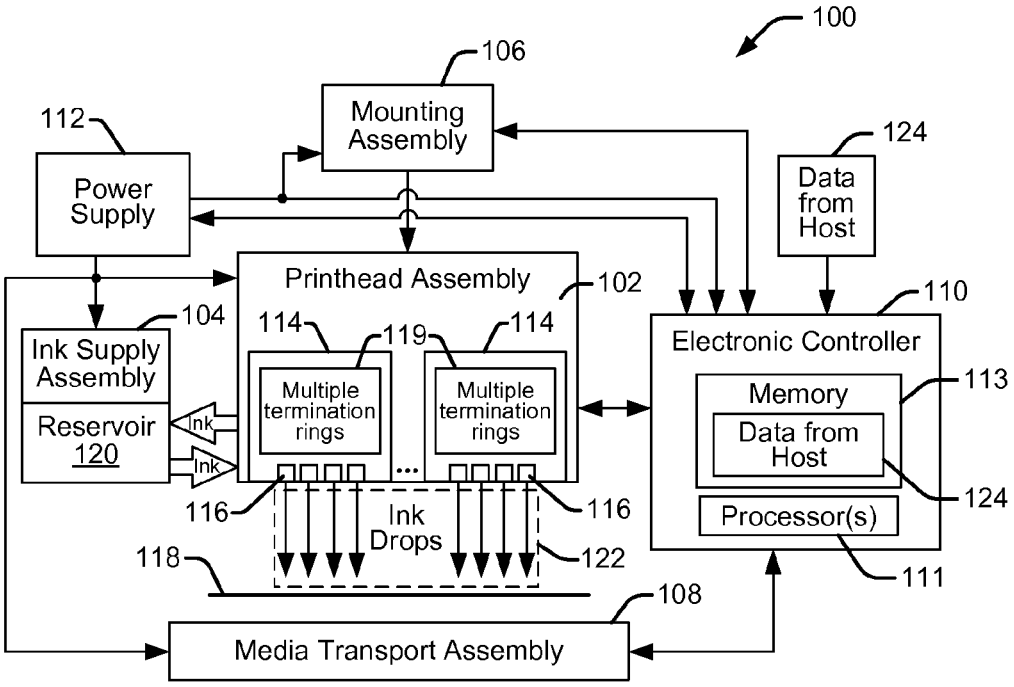
FIG. 1*a* illustrates a fluid ejection system implemented as an inkjet printing system, according to an embodiment.

As noted above, kerf chipping from saw blades can lead to defective printhead dies and reduced fabrication yields for printheads. Kerf chips can occur in both the silicon substrate and the thin-film layer formed on the substrate of a die. The extent to which a printhead die may be at risk of failure can depend on how far a kerf chip propagates toward and/or into the functional area of the die, which can typically be determined upon visual inspection. Kerf chipping can also lead to cracks that extend into the silicon substrate and the thin-film and fluidic layers fabricated on the substrate of a printhead die. In some cases, such cracks can propagate into the functional area of a printhead die, causing electrical and other failures in the die.

Printhead dies are generally less tolerant of saw kerf chipping and cracking than conventional semiconductor integrated circuit dies, due to the constant exposure of printhead dies to the corrosive effects of ink. A kerf chip that exposes the thin-films near the functional edge of a conventional semiconductor die may be tolerable because the die is typically covered in epoxy and/or otherwise packaged in a manner that prevents the kerf chip from causing a failure. However, a kerf chip that causes similar exposure to the thin-films near the functional edge of a printhead die will usually render the printhead die defective, because the functioning printhead die is in direct and constant contact with ink. The ink attacks and corrodes the thin-films and can lead to electrical failure of the printhead die if the kerf chip causes exposure of the thin-films too close to the functional edge of the die.

Efforts to produce more robust and reliable printhead die-edge terminations are ongoing. Previous approaches for reducing die defects from saw kerf chipping include making the width of the saw street much greater than the width of the saw blade. This solution typically results in highly reliable printhead dies, because saw blade kerf chips do not come close enough to the functional thin-film terminations along the edges of the dies to cause defective parts. One drawback to using wide saw streets, however, is that it involves the use of additional real estate on the wafer which results in a lower separation ratio (i.e., lower die per wafer) and higher costs.

Some conventional semiconductor dies include a protection ring formed around the die to help prevent the propagation of cracks into the inner, functional, region of the die. However, the protection ring in such semiconductor dies is formed in the layers above the die substrate and therefore provides little or no protection for the substrate itself. As a result, cracks often propagate into the functional region of the die through cracks that travel through the unprotected substrate. Furthermore, due to the corrosive ink environment in which printhead dies operate, a semiconductor die protection ring implemented in a printhead die is ineffective in preventing die failures from saw kerf chips. As noted above, a kerf chip that is terminated at the functional edge of a printhead die usually results in failure of the die because of the direct and continual exposure of the thin-films to ink at the functional edge of the die, which attacks and corrodes the thin-films, leading to electrical failure of a printhead die.

Embodiments of the present disclosure improve on prior efforts to prevent defective printhead dies caused by saw kerf chipping, generally by providing multiple termination rings that can each comprise a layer of silicon dioxide (SiO2) grown into the surface of a silicon substrate. The termination rings are concentric around the inner, functional area of the die, for example, with a first ring adjacent to the functional edge of the die and a second ring outside of the first ring. A berm comprising a layer of TEOS and BPSG separates the first and second termination rings. Together, the first ring, the berm, and the second ring provide three kerf chip break points or barriers. The kerf chip barriers help to dissipate the energy in saw kerf chips and prevent the kerf chips from propagating further inward toward the functional area of the printhead die.

In one example, a printhead die includes a silicon dioxide (SiO2) layer grown into the surface of a silicon substrate. A dielectric layer is formed on the surface of the substrate, and covers an interior area of the substrate. A first termination ring surrounds the interior area and is defined by an absence of the dielectric layer. A berm surrounds the first termination ring and is defined by the presence of the dielectric layer. A second termination ring then surrounds the berm and is also defined by an absence of the dielectric layer over.

In another example, a printhead die includes a SiO2 layer grown into a surface of a silicon substrate, and a dielectric layer deposited onto an interior surface area of a substrate. The die further includes multiple termination rings formed concentrically around the interior surface area. Each termination ring is defined by an absence of the dielectric layer. In between each of the multiple termination rings is a berm defined by the presence of the dielectric layer.

Illustrative Embodiments

FIG. 1*a* illustrates a fluid ejection system implemented as an inkjet printing system 100, according to an embodiment of the disclosure. Inkjet printing system 100 generally includes an inkjet printhead assembly 102, an ink supply assembly 104, a mounting assembly 106, a media transport assembly 108, an electronic controller 110, and at least one power supply 112 that provides power to the various electrical components of inkjet printing system 100. In this embodiment, fluid ejection devices 114 are implemented as fluid drop jetting printhead dies 114 (i.e., inkjet printhead dies 114). Inkjet printhead assembly 102 includes at least one fluid drop jetting printhead die 114 that ejects drops of ink through a plurality of orifices or nozzles 116 toward print media 118 so as to print onto the print media 118. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As discussed further below, each printhead die 114 comprises multiple termination rings 119 surrounding a functional interior area of the die to prevent saw kerf chips from propagating into the functional interior area. The termination rings 119 thus protect the die from attack at its edges by corrosive inks.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

Figure 1B:
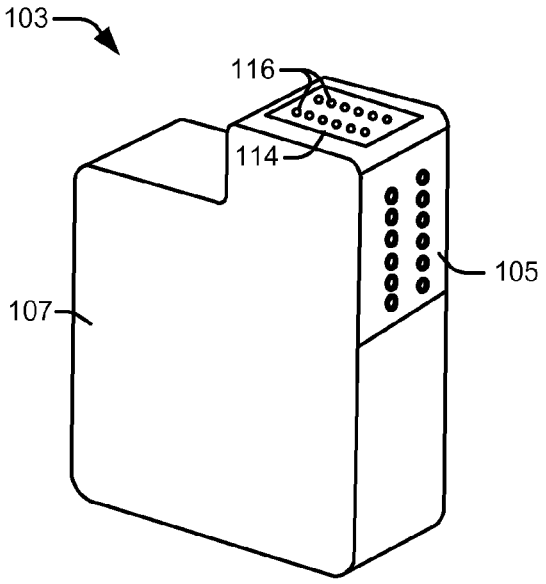
FIG. 1*b* shows a perspective view of an example inkjet cartridge that includes an inkjet printhead assembly and ink supply assembly, according to an embodiment.

In some implementations, as shown in FIG. 1*b*, inkjet printhead assembly 102 and ink supply assembly 104 (including reservoir 120) are housed together in a replaceable device such as an integrated inkjet printhead cartridge or pen 103. FIG. 1*b* shows a perspective view of an example inkjet cartridge 103 that includes inkjet printhead assembly 102 and ink supply assembly 104, according to an embodiment of the disclosure. In addition to one or more printhead dies 114, inkjet cartridge 103 includes electrical contacts 105 and an ink (or other fluid) supply chamber 107. In some implementations cartridge 103 may have a single supply chamber 107 that stores one color of ink, and in other implementations it may have a number of chambers 107 that each store a different color of ink. Electrical contacts 105 carry electrical signals to and from controller 110, for example, to cause the ejection of ink drops through nozzles 116.

In other implementations, ink supply assembly 104 is separate from inkjet printhead assembly 102 and supplies ink to inkjet printhead assembly 102 through an interface connection, such as a supply tube. In either implementation, reservoir 120 of ink supply assembly 104 can be removed, replaced, and/or refilled. Where inkjet printhead assembly 102 and ink supply assembly 104 are housed together in an inkjet cartridge 103, reservoir 120 can include a local reservoir located within the cartridge as well as a larger reservoir located separately from the cartridge. A separate, larger reservoir serves to refill the local reservoir. Accordingly, a separate, larger reservoir and/or the local reservoir can be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly that includes one printhead die 114. As such, mounting assembly 106 includes a carriage for moving inkjet printhead assembly 102 relative to media transport assembly 108 to scan print media 118. In another implementation, inkjet printhead assembly 102 is a non-scanning type printhead assembly with multiple printhead dies 114, such as a page wide array (PWA) print bar, or carrier. A PWA print bar print bar carries the printhead dies 114, provides electrical communication between the printhead dies 114 and electronic controller 110, and provides fluidic communication between the printhead dies 114 and the ink supply assembly 104. Thus, mounting assembly 106 fixes inkjet printhead assembly 102 at a prescribed position while media transport assembly 108 positions and moves print media 118 relative to inkjet printhead assembly 102.

In one implementation, inkjet printing system 100 is a drop-on-demand thermal bubble inkjet printing system comprising a thermal inkjet (TIJ) printhead die. The TIJ printhead die implements a thermal resistor ejection element in an ink chamber to vaporize ink and create bubbles that force ink or other fluid drops out of a nozzle 116. In another implementation, inkjet printing system 100 is a drop-on-demand piezoelectric inkjet printing system where a printhead die 114 is a piezoelectric inkjet (PIJ) printhead die that implements a piezoelectric material actuator as an ejection element to generate pressure pulses that force ink drops out of a nozzle.

Electronic controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters.

Figure 2:
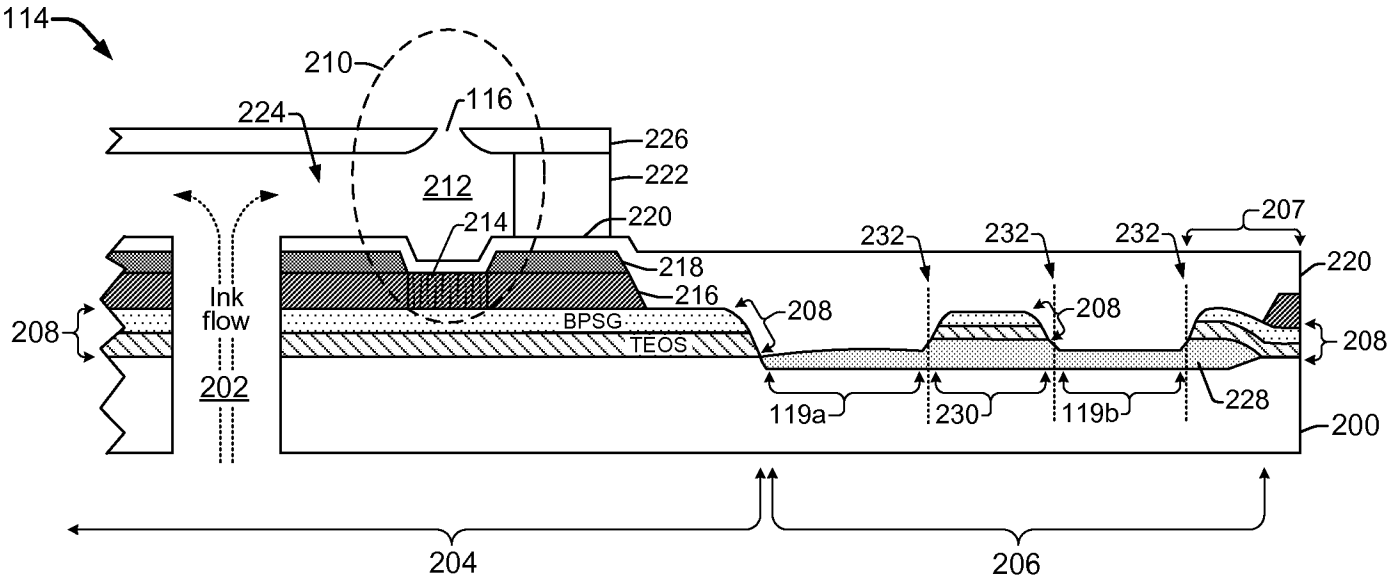
FIG. 2 shows a cross-sectional view of a portion of an example printhead die, according to an embodiment.

FIG. 2 shows a cross-sectional view of a portion of an example printhead die 114, according to an embodiment. The portion of the printhead die 114 shown in FIG. 2 generally illustrates the right side of the die. The left side of the die 114 is not shown, but would be a mirror image of the right side. A printhead die 114 is formed in part, of a layered architecture that includes a substrate 200 (e.g., silicon) with a fluid slot 202 or trench formed therein, and various thin-film layers such as a conductive metal layer, a resistive layer, a dielectric layer, a passivation layer, and other layers. It should be noted that the features and layers of the printhead die 114 shown in FIGS. 2-9 are not intended to be drawn to scale. Thus, a particular layer in FIG. 2 may appear to be thicker than it should when compared to the appearance of another layer in FIG. 2. Furthermore, the features and layers of the printhead die 114 shown and discussed in FIGS. 2-9 are not intended to represent an exhaustive list of features and layers that might be present in a given printhead die 114. Accordingly, a given printhead die 114 may include additional features and layers (e.g., a bond pad layer and an adhesive layer) that are not shown in FIGS. 2-9.

In general, the features and layers of the printhead die 114 can be formed using various precision microfabrication techniques such as thermal oxidation, electroforming, laser ablation, sputtering, spin coating, physical vapor deposition (PVD), chemical vapor deposition (CVD), electrochemical deposition (ECD), etching, photolithography, casting, molding, stamping, machining, and the like. Photolithography and masks can be used to pattern layers by protecting and/or exposing the patterns to etching, which removes material from the patterned layers. Etching can be isotropic or anisotropic, and can be performed using various etching techniques such as wet etching, dry etching, chemical-mechanical planarization (CMP), reactive-ion etching (RIE), and deep reactive-ion etching (DRIE). Features of a printhead die 114 resulting from the deposition, patterning, and etching of layers can include resistors, capacitors, sensors, wires, ink chambers, fluid flow channels, contact pads, and traces that can connect the resistors and other electrical components together.

Figure 3:
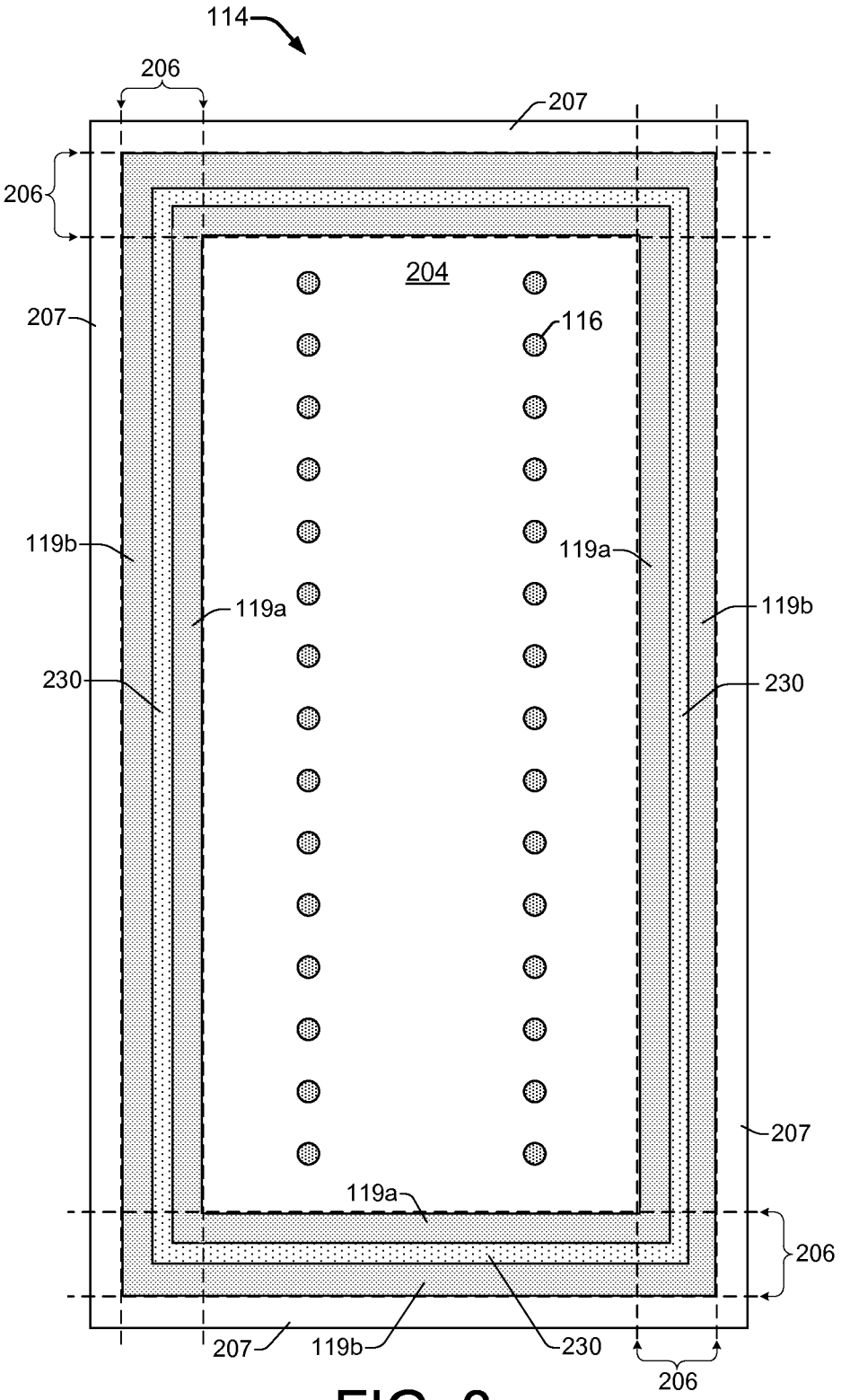
FIG. 3 shows a plan view of an example printhead die, according to an embodiment.

The printhead die 114 can be characterized in part as including a functional area 204 and a frame area 206. As shown in FIG. 2, the functional area 204 is an interior area of the die 114 surrounded by the frame area 206. Outside of the frame area 206, a portion of the saw street 207 typically remains after the die 114 has been cut away from the wafer. However, for the purposes of this disclosure, the edges and perimeter of the printhead die 114 are considered to be where the frame area 206 ends, or where it meets the saw street 207. The interior functional area 204, the frame area 206, and the remaining portion of the saw street 207 of the die 114 can be more readily observed in the plan view of an example printhead die 114, as shown in FIG. 3. The interior functional area 204 of the die 114 is generally defined by a dielectric layer 208 deposited onto the substrate 200. In addition to having the deposited dielectric layer 208, the interior functional area 204 of the die 114 includes various functional features that participate more directly in the ejection of fluid ink drops from the die. These functional features include the fluid slot 202 and drop generators 210. Each drop generator 210 includes a nozzle 116, an ink chamber 212, and a thermal firing resistor 214 that ejects ink drops through the nozzle 116 by heating a small layer of fluid surrounding the resistor within the chamber 204, which creates a vapor bubble that forces ink out of the nozzle 116.

The dielectric layer 208 is a patterned thin-film layer comprising two materials deposited on top of the substrate 200. The first material of the dielectric layer 208 deposited onto the substrate 200 is silicon oxide (SiO2) formed by chemical vapor deposition (CVD) with the precursor TEOS (tetraethyl orthosilicate). The second material in the dielectric layer 208 is SiO2 formed by CVD with the precursor BPSG (borophosphosilicate glass) which is deposited on the TEOS layer. Other materials may also be suitable for the dielectric layer 208, such as undoped silicate glass (USG), silicon carbide or silicon nitride. Together, the TEOS and BPSG form the dielectric layer 208, which provides electrical insulation to prevent electrical shorting. The thickness of the dielectric layer 208 is on the order of between 0.5 and 2.0 microns. In general, the thickness and thermal conductivity and diffusivity properties of dielectric layer 208 provide electrical isolation of circuits relative to the substrate.

The functional area 204 of the printhead die 114 includes resistive layer 216 deposited on top of dielectric layer 208. Thermal resistors 214 are formed in the resistive layer 216. The resistive layer can be formed of different materials including tungsten silicide nitride (WSiN), tantalum silicide nitride (TaSiN), tantalum aluminum (TaAl), tantalum nitride (Ta2N), or combinations thereof. The resistive layer is typically on the order of between 0.025 and 0.2 microns thick.

A conductive metal layer 218 is deposited on top of the resistive layer 216 and can be used to provide current to the thermal resistor 214, and/or to couple the thermal resistor 214 to a control circuit or other electronic circuits on the printhead die 114. In other implementations the conductive layer 218 can be located underneath the resistive layer 216 to provide current to the thermal resistor 214. The conductive metal layer 218 can include materials such as platinum (Pt), aluminum (Al), tungsten (W), titanium (Ti), molybdenum (Mo), palladium (Pd), tantalum (Ta), nickel (Ni), copper (Cu) with an inserted diffusion barrier, and combinations thereof.

Another dielectric and/or passivation layer 220 can be deposited on the conductive metal layer 218 and can extend down through a via in the conductive metal layer 218 to the resistive layer 216, as shown in FIG. 2. The passivation layer 220 can function as a dielectric and as a cavitation barrier that protects the underlying circuits and layers from oxidation, corrosion, and other environmental conditions, such as the impact from collapsing vapor bubbles inside the chamber 212. The passivation layer 220 can be formed of materials such as silicon carbide (SiC), silicide nitride (SiN), TEOS, and combinations thereof.

Within the functional area of printhead die 114, the chamber 212 is defined by a chamber layer 222 formed over the various underlying layers (e.g., passivation layer 220, conductive metal layer 218, resistive layer 216, dielectric layer 208) and the substrate 200. As shown in FIG. 2, the chamber layer 222 also defines a fluidic channel 224 (and other fluidic channels, not shown) which is the primary flow path for ink flowing into the chambers 212 from the fluid slot 202. The chamber layer 222 is typically formed of SU8 epoxy, but can also be made of other materials such as a polyimide.

A tophat layer or nozzle layer 226, is formed over the chamber layer 222 and includes nozzles 116 that each correspond with a respective chamber 212 and thermal resistor 214. The nozzle layer 226 forms a top over the slot 202 and other fluidic features of the chamber layer 222 (e.g., fluidic channels 224, and chambers 212). The nozzle layer 226 is typically formed of SU8 epoxy, but it can also be made of other materials such as a polyimide.

As shown in FIGS. 2 and 3, the frame area 206 of printhead die 114 is an exterior area of the die substrate that extends from the edges of the functional area 204 outward to the perimeter, or edges of the die 114. As noted above, while a portion of the saw street 207 typically remains around the die 114 after it has been cut away from the wafer, for the purposes of this disclosure the edges and perimeter of the printhead die 114 are considered to be where the frame area 206 ends, or where it meets the saw street 207. Thus, the frame area 206 surrounds the interior functional area 204 and extends from the outside edges of the die inward, until it contacts or meets with the interior functional area 204. The frame area 206 does not include functional features that participate directly with the process of ejecting fluid ink drops from the die. Instead, as noted above, the frame area 206 includes multiple termination rings 119 surrounding the functional interior area 204 of the die that help prevent saw kerf chips from propagating into the functional interior area. The termination rings 119 thus protect the die from attack at its edges by corrosive inks.

Figure 4:
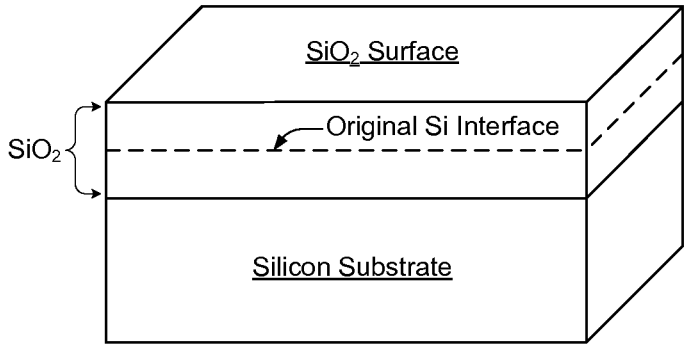
FIG. 4 shows a perspective view of an example portion of a silicon substrate that includes a grown SiO2 layer, according to an embodiment.

The frame area 206 is generally defined by a layer of silicon dioxide (SiO2) that is grown into the surface of the silicon substrate 200. The grown SiO2 layer 228 covers the whole substrate surface within the frame area 206. The SiO2 layer 228 is a grown oxide layer, as opposed to being a deposited layer (e.g., by CVD, chemical vapor deposition), and it therefore provides greater integrity and higher strength to the silicon substrate, which helps prevent saw kerf chips and cracks originating in the saw street 207 from propagating through the substrate 200. FIG. 4 shows a perspective view of an example portion of a silicon substrate that includes a grown SiO2 layer 228, according to an embodiment. When the SiO2 layer is grown on a silicon substrate (e.g., in a diffusion furnace using a wet or dry growth method), oxidation reactions occurring at the Si/SiO2 interface consume the silicon, which moves the interface into the silicon substrate such that the SiO2 layer penetrates the surface of the silicon substrate. Referring again to FIG. 3, it is apparent that the SiO2 layer 228 has undergone such a growth process into the surface of the silicon substrate 200. Such a grown SiO2 layer 228 is typically referred to as a field oxide layer, or FOX layer.

A first termination ring 119*a* located within the frame area 206 of printhead die 114 is adjacent to and surrounds the functional interior area 204 of the die 114. The first termination ring 119*a* is concentric around the functional interior area 204, and is defined by an area of the grown SiO2 layer 228 and an absence of the dielectric layer 208 over a portion of the grown SiO2 layer. That is, the dielectric layer 208 has been removed from over the grown SiO2 layer 228 in the area of the first termination ring 119*a*. Covering the SiO2 layer in the area of the first termination ring 119*a* is the passivation layer 220, or second dielectric layer.

A berm 230 located within the frame area 206 of printhead die 114 is adjacent to and surrounds the first termination ring 119*a*. The berm is concentric around the first termination ring 119*a*, and is defined by the presence of the dielectric layer 208 over an area of the grown SiO2 layer 228 within the berm area. That is, a portion of the dielectric layer 208 (including a layer of TEOS and BPSG), remains deposited over the grown SiO2 layer 228 within the area of the berm 230.

A second termination ring 119*b* located within the frame area 206 of printhead die 114 is adjacent to and surrounds the berm 230. The second termination ring 119*b* is concentric around the functional interior area 204, and is defined by an area of the grown SiO2 layer 228 and an absence of the dielectric layer 208 over a portion of the SiO2 layer. That is, the dielectric layer 208 has been removed from over the grown SiO2 layer 228 in the area of the second termination ring 119*b*. Covering the grown SiO2 layer 228 in the area of the second termination ring 119*b* is the passivation layer 220, or second dielectric layer.

Break lines 232 are defined within the frame area 206 at the intersections or borders in areas of the grown SiO2 layer 228 that are with, and without, coverage by the BPSG and TEOS of the dielectric layer 208. The break lines 232 act as barriers to kerf chip propagation. In general, there are kerf chip barriers 232 present wherever there are transitions between areas that have the BPSG and TEOS dielectric layer 208 and areas that do not have the BPSG and TEOS of the dielectric layer 208. Thus, there are kerf chip barriers 232 present on either side of the berm 230 where the berm 230 borders the two termination rings 119. In addition, because the saw street 207 has a portion of the dielectric layer 208 remaining, there is also a kerf chip barrier 232 at the edge of the substrate die where the frame area 206 and second termination ring 119*b* border the saw street 207.

This disclosure contemplates and is intended to cover embodiments in which more than two termination rings 119 are present within the frame area 206 of the printhead die 114. For each additional termination ring 119 included, an additional berm 230 is also present. In this manner, additional kerf chip barriers 232 can be designed and fabricated into printhead dies to provide further protection from kerf chip propagation and improved printhead die fabrication yields.

Furthermore, while one configuration of the layered architecture of a printhead die 114 has been illustrated and discussed with regard to FIG. 2, various other configurations of a layered architecture are possible and are contemplated by this disclosure. For example, FIGS. 5-9 illustrate a number of printhead die configurations in which the layered architectures vary from that shown in FIG. 2, according to different embodiments. In general, the printhead die configurations shown in FIGS. 5-9 include variations from the FIG. 2 configuration in which the underlying SiO2 layer 228 is grown into the substrate 200 over different areas of the substrate surface, and in some cases, where such grown SiO2 layer 228 has been removed.

Figure 5:
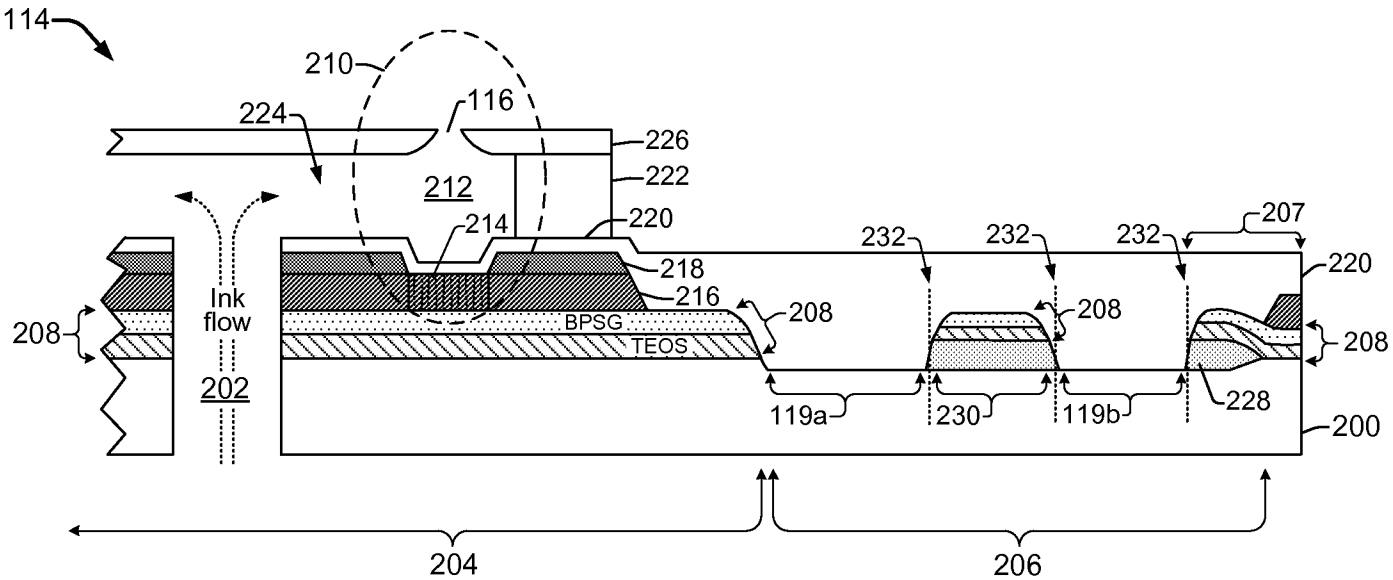
FIGS. 5-9 show varying printhead die configurations in which layered architectures vary from one another, according to different embodiments.
Figure 6:
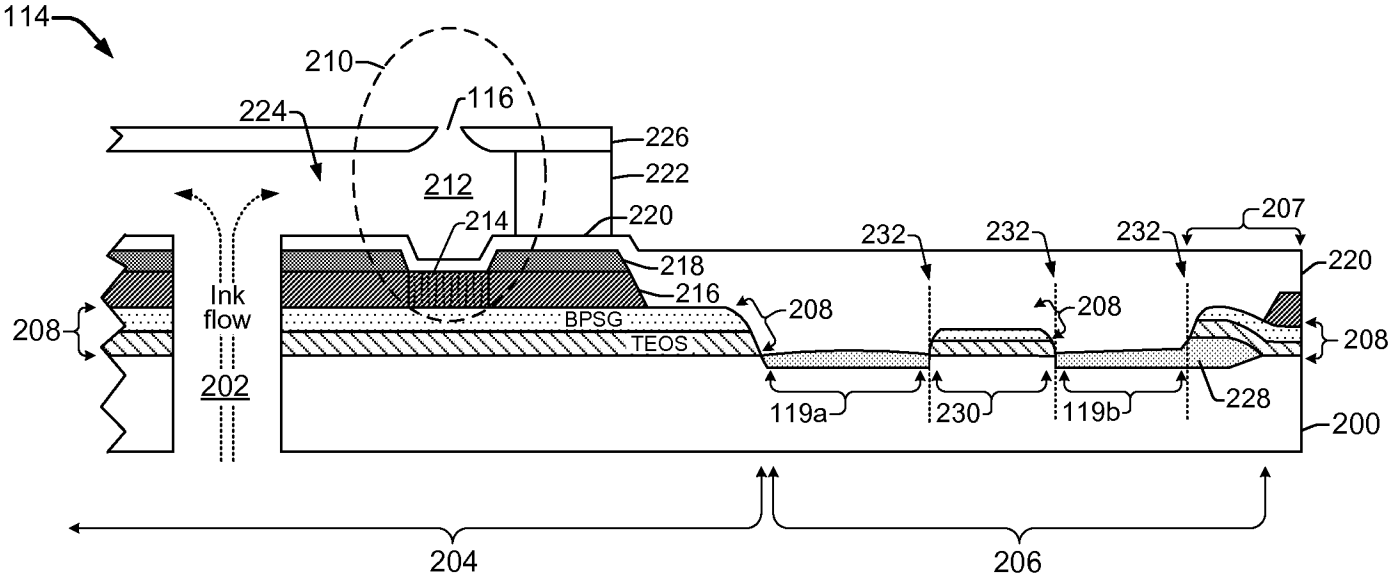
Figure 7:
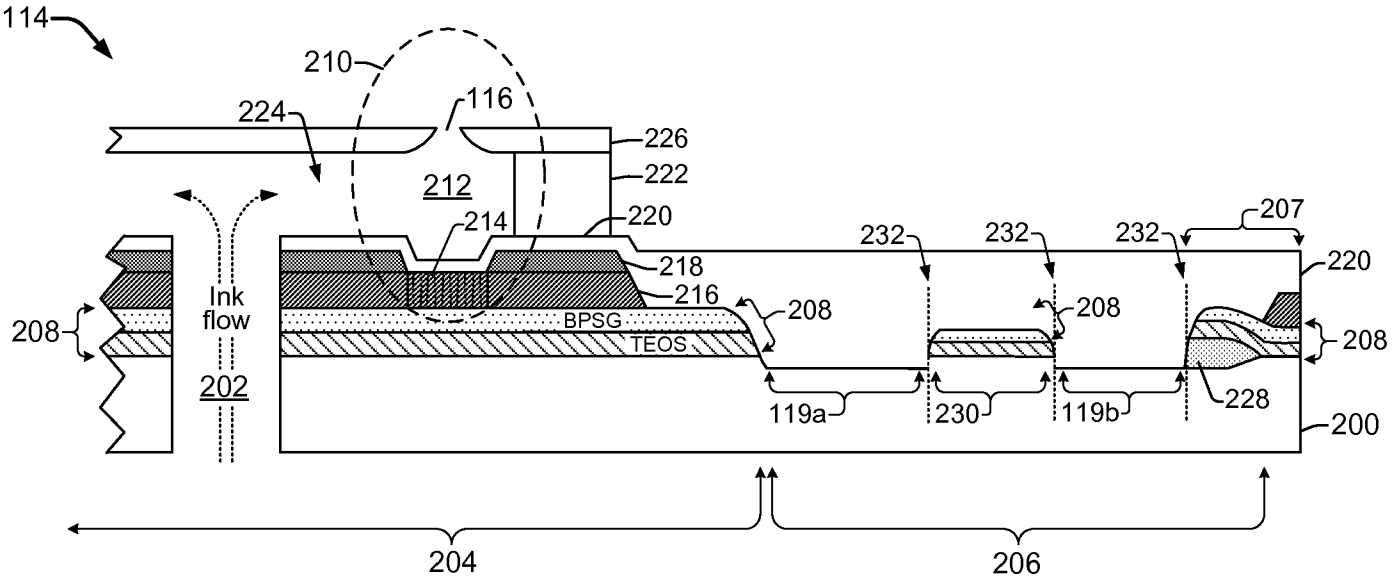
Figure 8:
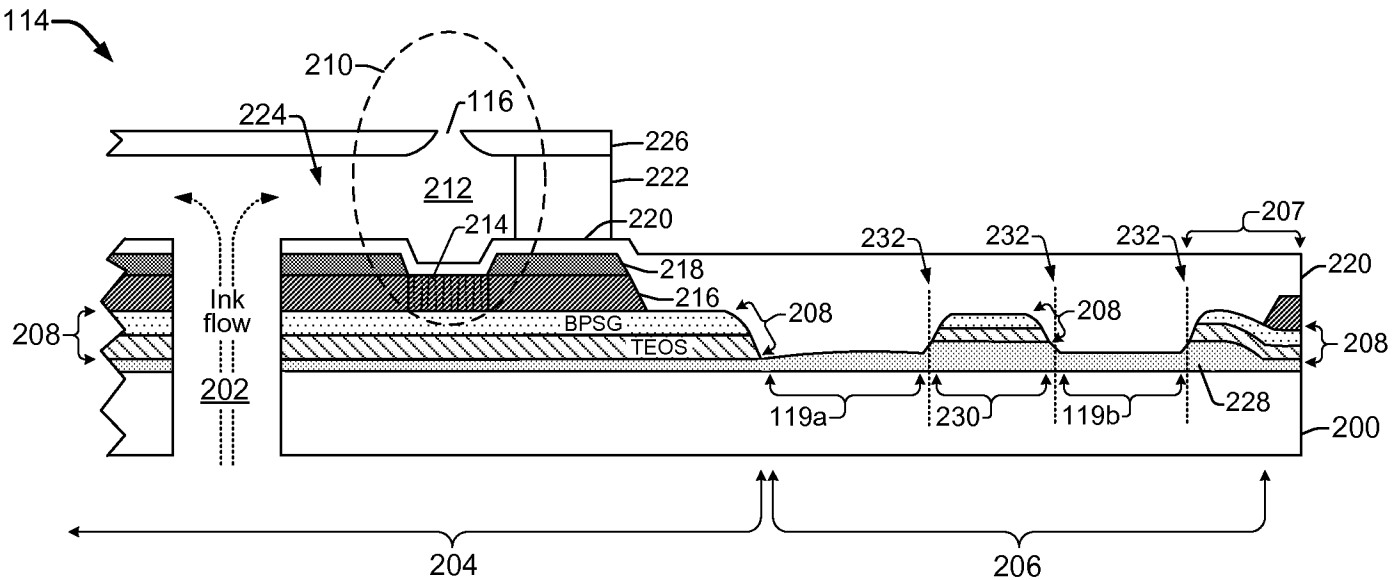
Figure 9:
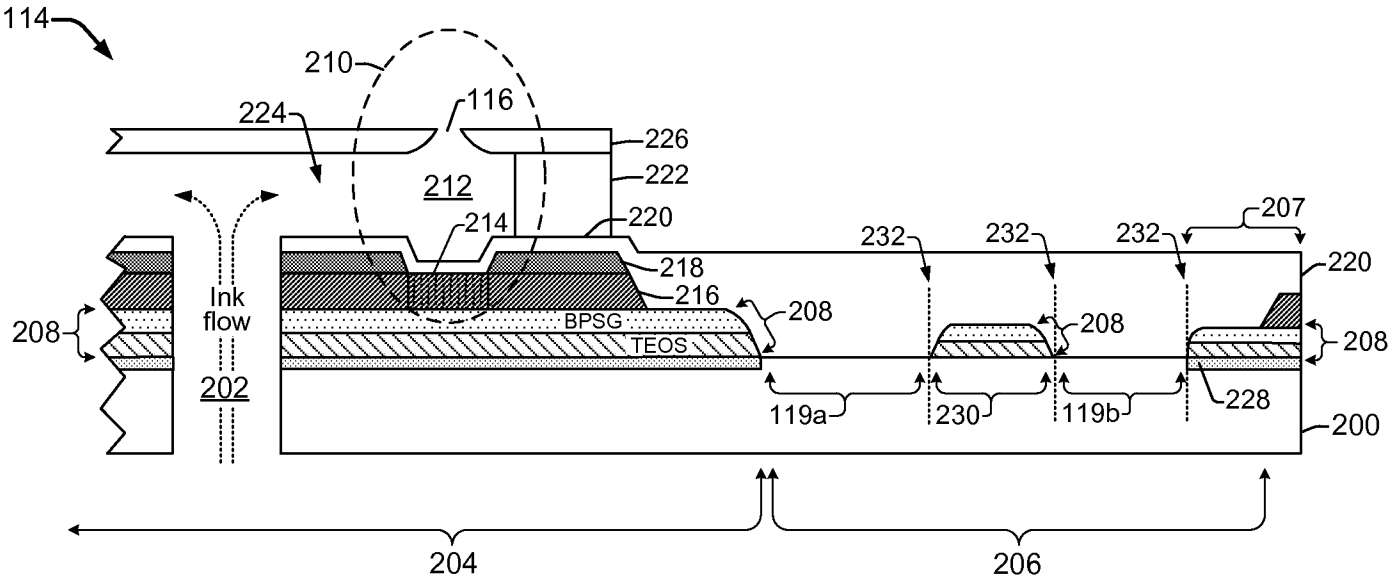

As noted above, the layered architecture of the printhead die 114 shown in FIG. 2 includes a layer of silicon dioxide (SiO2) that is grown into the surface of the silicon substrate 200 over the frame area 206. FIG. 5 shows another example of a printhead die 114 in which the grown SiO2 layer 228 shown in FIG. 2 has been fully removed from the areas of the first termination ring 119*a* and the second termination ring 119*b* within the frame area 206. Thus, in this example, the SiO2 layer was grown into the substrate over the frame are 206 and then removed from particular locations. FIG. 6 shows an example of a printhead die 114 in which the SiO2 layer 228 is grown within the frame area 206, except in the area of the berm 230. Thus, there is grown SiO2 228 underlying both the first and second termination rings 119, but there is no grown SiO2 underlying the berm 230. FIG. 7 shows an example of a printhead die 114 in which the SiO2 layer 228 is grown within the frame area 206 underlying the first and second termination rings 119, and then removed from these areas. In this example, the SiO2 layer 228 is not grown in the area of the berm 230. Thus, as shown in FIG. 7, there is no SiO2 layer 228 underlying the first and second termination rings 119 or the berm 230. FIG. 8 shows an example of a printhead die 114 in which the SiO2 layer 228 is grown into the substrate 200 over the entire surface area of the substrate. Thus, in this example, the grown SiO2 layer 228 underlies the termination rings 119 and berm 230 within the frame area 206, the saw street 207 area, and the interior functional area 204 of the die 114. FIG. 9 shows an example of a printhead die 114 in which the SiO2 layer 228 is grown within the interior functional area 204 and the saw street 207 area of the die 114, but not within the frame area 206 of the die 114. Thus, in this example the grown SiO2 layer 228 is not underlying the termination rings 119 or the berm 230, and is generally located on the die surface in a manner that is opposite to that shown in FIG. 2.

What is claimed is:

1. A printhead die comprising:

a SiO2 layer grown into a surface of a silicon substrate;

a dielectric layer formed on the surface over an interior area of the substrate;

a first termination ring surrounding the interior area and defined by an absence of the dielectric layer;

a berm surrounding the first termination ring and defined by the presence of the dielectric layer; and a second termination ring surrounding the berm and defined by an absence of the dielectric layer.

2. A printhead die as in claim 1 wherein the SiO2 layer covers a frame area of the substrate that surrounds the interior area and extends from the interior area to edges of the substrate, such that the SiO2 layer underlies the termination rings and the berm.

3. A printhead die as in claim 2 wherein the SiO2 layer has been removed from under the termination rings.

4. A printhead die as in claim 2 wherein the SiO2 layer has been removed from under the berm.

5. A printhead die as in claim 2 wherein the SiO2 layer covers part of the frame area such that the SiO2 layer underlies the termination rings but does not underlie the berm.

6. A printhead die as in claim 1 wherein the SiO2 layer covers the interior area of the substrate and a saw street area surrounding the second termination ring, but does not cover a frame area of the substrate underlying the termination rings and the berm.

7. A printhead die as in claim 1, wherein the dielectric layer comprises a thin-film layer of TEOS deposited on the surface and BPSG deposited on the TEOS.

8. A printhead die as in claim 1, further comprising kerf chip barriers at borders between the berm and the termination rings.

9. A printhead die as in claim 8, wherein a kerf chip barrier comprises an intersection between a presence of the dielectric layer and an absence of the dielectric layer.

10. A printhead die as in claim 1, further comprising:

a portion of a saw street bordering the second termination ring; and a kerf chip barrier at the border between the second termination ring and the saw street.

11. A printhead die as in claim 1, further comprising:

a fluid slot formed in the substrate; and a drop generator formed on the substrate to eject fluid drops.

12. A printhead die as in claim 11, wherein the drop generator comprises:

a thermal resistor formed in a resistive layer;

a fluidic chamber defined by a chamber layer; and a nozzle defined by a nozzle layer.

13. A printhead die comprising:

a SiO2 layer grown into a surface of a silicon substrate;

a dielectric layer deposited onto an interior surface area of the substrate;

multiple termination rings formed concentrically around the interior surface area, each ring defined by an absence of the dielectric layer; and a berm in between each termination ring, each berm defined by the presence of the dielectric layer.

14. A printhead die as in claim 13, wherein the multiple termination rings are each further defined by the SiO2 layer.

15. A printhead die as in claim 13, wherein each berm is further defined by the SiO2 layer underlying the dielectric layer.

16. A printhead die as in claim 13, wherein the SiO2 layer covers the interior surface area and a saw street area, but does not cover a frame area in which the multiple termination rings and berms are formed, the frame area being in between the interior surface area and the saw street area.

17. A printhead die as in claim 13, further comprising kerf chip barriers defined by each border between the multiple termination rings and the berms.

18. A printhead die as in claim 13, further comprising:

a resistive layer deposited on the dielectric layer;

a thermal resistor formed within the resistive layer;

a chamber layer forming a fluidic chamber over the thermal resistor; and a tophat layer forming a nozzle over the fluidic chamber.

* * * * *